US006290392B1

(12) United States Patent
Sandor

(10) Patent No.: US 6,290,392 B1
(45) Date of Patent: Sep. 18, 2001

(54) RECLOSABLE PLASTIC BAG WITH DEFORMABLE, STAY-OPEN INLAY

(76) Inventor: Joseph Sandor, 411 Dahlia Ave., Corona Del Mar, CA (US) 92625

( * ) Notice: Subject to any disclaimer, the term of this patent is extended or adjusted under 35 U.S.C. 154(b) by 0 days.

(21) Appl. No.: 09/706,550

(22) Filed: Nov. 6, 2000

(51) Int. Cl.[7] ..... B65D 33/16
(52) U.S. Cl. ..... 383/33; 383/63; 24/587
(58) Field of Search ..... 383/33, 63, 34, 383/905; 24/587, 576, 577

(56) References Cited

U.S. PATENT DOCUMENTS 3,679,531 * 7/1972 Wienand et al. ..... 428/33
3,955,245 * 5/1976 Ballin ..... 24/577
4,610,358 * 9/1986 Walter ..... 383/905 X
4,796,300 * 1/1989 Branson ..... 383/63
5,027,965 7/1991 Dumars .
5,037,138 * 8/1991 McClintock et al. ..... 383/34
5,174,658 12/1992 Cook et al. .
5,354,132 * 10/1994 Young et al. ..... 383/33 X
5,852,830 * 12/1998 Horn ..... 383/33 X
6,116,780 * 9/2000 Young et al. ..... 383/33 X

* cited by examiner

*Primary Examiner*—Jes F. Pascua
(74) *Attorney, Agent, or Firm*—Edgar W. Averill, Jr.

(57) ABSTRACT

A reclosable plastic bag having first and second securement strips near the open top of the bag. A wire or other inelastically deformable member is extruded or otherwise placed adjacent the opening of the bag. Then when the bag is opened, the top can be bent into a desired shape so that the bag will stay open. This makes the filling, emptying or using of the contents much easier than the conventional plastic bag.

5 Claims, 2 Drawing Sheets

RECLOSABLE PLASTIC BAG WITH DEFORMABLE, STAY-OPEN INLAY

BACKGROUND OF THE INVENTION

The field of the invention is containers and the invention relates more particularly to reclosable plastic bags. Said bags typically have first and second strips adjacent the top thereof. These strips interlock to reclosably close and permit opening of the bag.

Plastic bags with a reclosable top of the type commonly sold under the trademark "ZIPLOC" bags are in widespread use. When one wants to place articles in such bags, it is often difficult to hold the top of the bag open. Such bags tend to move into a closed position and it takes two hands to maintain a wide opening to facilitate filling.

U.S. Pat. No. 5,027,965, shows a fuel overflow collection device. In one form, this device utilizes a plastic bag having one side larger than the other side and having a wire imbedded in a pouch formed in the bag. The bag is adhered under a fuel overflow vent to capture overflowing fuel and prevent it from entering the water way.

U.S. Pat. No. 5,174,658 shows a self-expanding and reclosable flexible bag. This bag has a pair of plastic stays which are made from a relatively stiff resilient material having a memory, such as Nylon or high-density polyethylene. The strips are shaped so that in an unstressed configuration they are circular or elliptical. Thus, when the bag is opened it will tend to form an almost circular opening to facilitate the filling or emptying of the contents of the bag.

There are many instances when one would like to have the "ZIPLOC" style bag stay open so that both hands could be used to fill the bag. Furthermore, it is sometimes desired to temporarily secure the bag over, for instance, a bottle opening to facilitate the transfer of the contents of a bottle, for instance, of pills into the plastic bag.

BRIEF SUMMARY OF THE INVENTION

It is an object of the present invention to provide bags, especially plastic bags, and predominantly reclosable plastic bags with an inelastically deformable member secured adjacent the opening of such bag or the reclosing strips of a bag which has a closure similar to that found in plastic bags sold under the trademark "ZIPLOC." In this way, the bag may be deformed into a desired shape to assist in the filling or emptying of its contents.

The present invention is for a plastic bag of the type having a male and a female securement means near a top of an upper opening thereof. The improved plastic bag of the present invention has a first inelastically deformable member secured adjacent the opening along one side extending from the right end to the left end of the bag. Similarly, a second inelastically deformable member is secured adjacent the opening along the other side and also extends from the right end to the left end of the bag. The ends of the two inelastically deformable members are interlocked or fuzed within the plastic at the right and left ends thereof so that the right and left sides function together as an integral unit. The inelastically deformable members may be metal, such as iron or stainless steel, or a highly filled polymer which exhibits the property of inelastic deformability.

DESCRIPTION OF THE PREFERRED EMBODIMENTS

Figure 1:
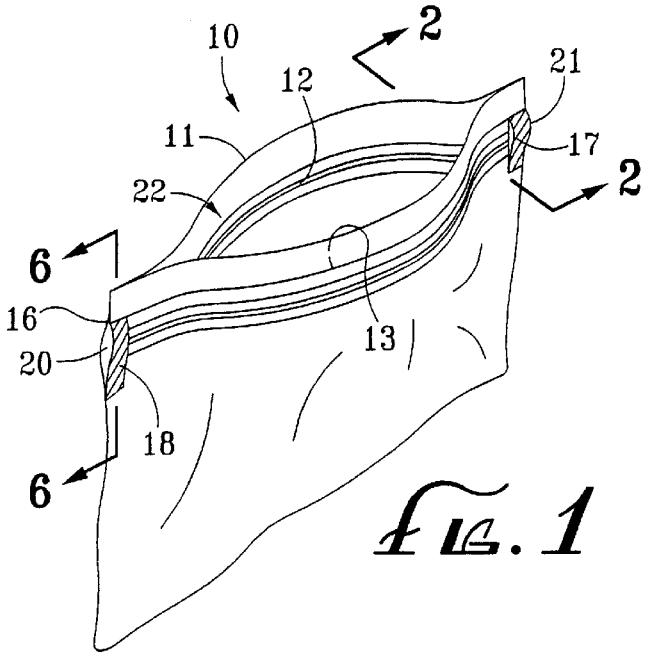
FIG. 1 is a perspective view of the reclosable plastic bag with deformable stay open inlay of the present invention.

A reclosable plastic bag is shown in FIG. 1 of the drawings and indicated generally by reference character 10. Bag 10 has a top 11 with a female securement means 12 on one side thereof. A male securement means 13 is formed along the other side of bag 10. The bag has a pair of inelastically deformable members, one positioned adjacent the female securement means 12 and the other positioned adjacent the male securement means 13. These are shown in cross-sectional view in FIG. 2 and the female inelastically deformable member is indicated by reference character 14, and the male inelastically deformable member is indicated by reference character 15. Inelastically deformable members 14 and 15 extend to a left side 16 and to a right side 17 of bag 10. The ends of the inelastically deformable members are fused together by a fused area 18 on the left side and a fused area 19 on the right side. The left ends of the inelastically deformable members are indicated by reference character 20 and the right ends by reference character 21.

Because of the presence of inelastically deformable members 14 and 15, the bag will stay open, as shown in FIG. 1, and provide an easily accessible upper opening 22.

Figure 2:
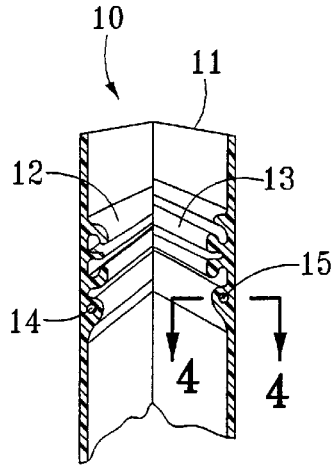
FIG. 2 is a cross-sectional view taken along line 2—2 of FIG. 1.
Figure 6:
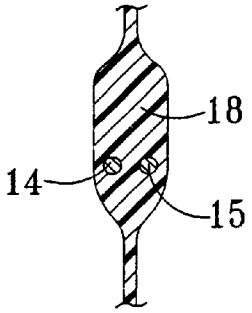
FIG. 6 is a cross-sectional view taken along line 6—6 of FIG. 1.
Figure 9:
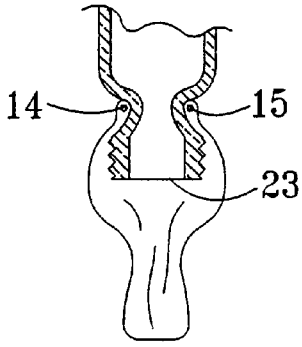
FIG. 9 is a cross-sectional view of the bag of FIG. 1 formed around the open end of a plastic bottle.
Figure 10:
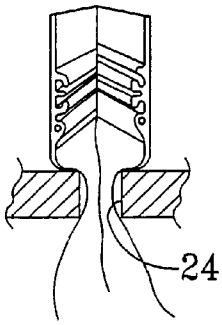
FIG. 10 is a cross-sectional view of the bag of FIG. 1 secured over a gap between two members.

The upper end of bag 10 is shown in cross-sectional view in FIG. 2 where the female securement means 12 and the male securement means 13 can be seen. Both inelastically deformable members are positioned adjacent to the male and female securement means which are typically at the opening of such bag. They are also held together by being fused within the plastic as shown best in FIG. 6 of the drawings. In this way, the two inelastically deformable members 14 and 14 are held together to form an integral unit which will assist in the temporary forming of the opening into a desired shape. In this way, the top can be shaped to almost any desired configuration. Thus, the top can be configured to wrap around the open end of a bottle, such as that indicated by reference character 23 in FIG. 9. It can also be expanded over an open gap, such as gap 24 shown in FIG. 10. If the ends were not fused together, such a holding method would be unstable. Thus, the unitary joining of the two inelastically deformable members forms a preferred part of the present invention. Gap 24 could be the opening of a cup or bowl which would greatly facilitate the filling of such bags.

Figure 3:
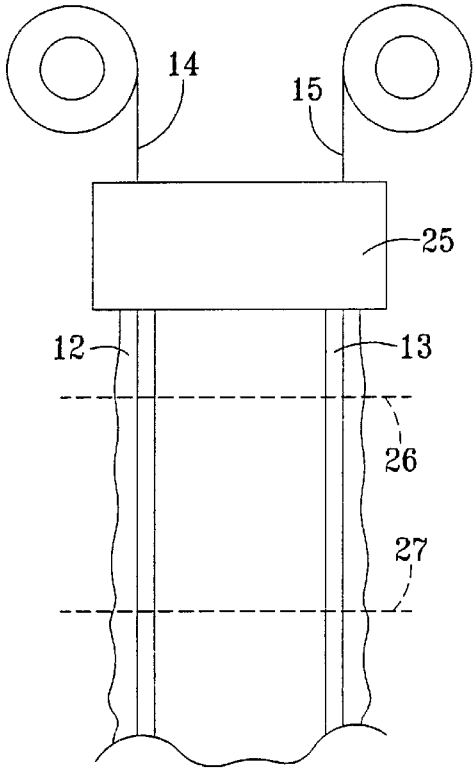
FIG. 3 is a diagrammatic plan view of an extruder shown forming the extrusion used to fabricate the bag of the present invention.

The inelastically deformable members 14 and 15 can be secured to the plastic bag by various means. In the preferred embodiment, the inelastically deformable members 14 and 15 are added in a manner consistent with existing manufacturing methods of reclosable bags. Therefore, the most common way of forming a reclosable plastic bag of the present invention is indicated diagrammatically in FIG. 3 where an extruder head 25 is fed a pair of wires 14 and 15, which form the inelastically deformable members. Plastic is extruded around the wires 14 and 15 and shaped in a member which form the first and second interlocking securement means 12 and 13. The bag is then cut along dotted lines 26 and 27. It is next folded between securement means 12 and 13, and sealed along the left end and a right end as well as being fused along fused areas 18 and 19. By such fabrication means, the wire or other inelastically deformable member is integrally formed into the unitary configuration discussed above.

Figure 4:
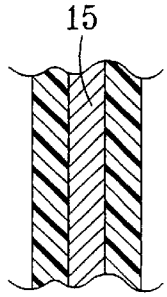
FIG. 4 is a cross-sectional view taken along line 4—4 of FIG. 2.
Figure 5:
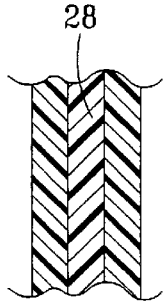
FIG. 5 is a cross-sectional view showing a polymeric inelastically deformed member analogous to FIG. 4.

Inelastically deformable member 15 is shown in enlarged cross-sectional view in FIG. 4 and a polymeric inelastically deformable member is shown in enlarged cross-sectional view in FIG. 5 and indicated by reference character 28. Such polymeric inelastically deformable member may be fabricated from any polymer having this property and it has been found that highly filled polymers, filled with such filler as talc, exhibit this property. A polymeric inelastically deformable member would typically be fabricated of a larger cross-section than the iron or stainless steel wire.

Figure 7:
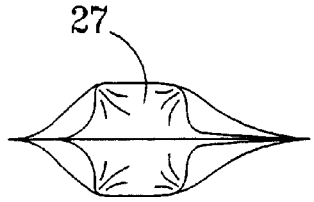
FIG. 7 is a top view of an opened reclosable plastic bag with deformable stay open inlays.

Because of the inelastic deformation, the top may be formed in a unique shape such as that indicated by reference character 25 in FIG. 7.

Figure 8:
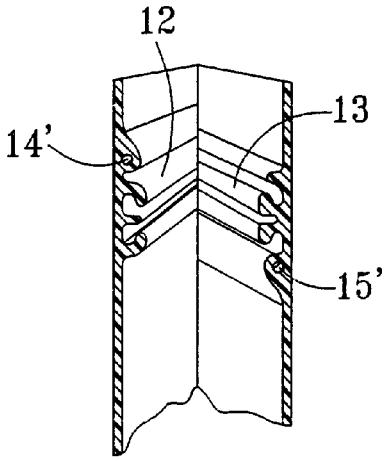
FIG. 8 is a cross-sectional view analogous to FIG. 2 with an alternate placement of an inelastically deformable member.

The inelastically deformable members need not necessarily be positioned below the male and female securement members, but could both be above, or one could be above and the other below as indicated in FIG. 8. The inelastically deformable member above the female securement means 12 is indicated by reference character 14'.

The result is an inexpensive reclosable plastic bag which is far more user friendly than conventional bags. Both the fabrication and materials necessary to make such bags are inexpensive and provide a large measure of improved user adaptability.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A reclosable plastic bag of the type having a first male and female second securement means near a top of an upper opening thereof, said first male and female second securement means extending to right and left ends of the bag, wherein the improvement comprises:

a first inelastically deformable member secured adjacent said first securement means, said first inelastically deformable member extending from said right end to said left end of said reclosable bag;

a second inelastically deformable member secured adjacent said second securement means, said second inelastically deformable member extending from said right end to said left end of said reclosable bag and wherein said first and said second inelastically deformable members have a right end and a left end and wherein said first and second inelastically deformable members are secured together at the right and left ends thereof whereby when said bag is opened and the first and/or second inelastically deformable members are bent into a desired shape, the inelastically deformed member will retain the bent shape and facilitate the emptying, filling or using the contents thereof.

2. The reclosable plastic bag of claim 1 wherein said inelastically deformable members are fabricated from metal wire.

3. The plastic pouch of claim 1 wherein said first and second inelastically deformable members are positioned below said first male and female securement means.

4. The reclosable plastic bag of claim 1 wherein said inelastically deformable members are fabricated from a polymer.

5. A reclosable plastic bag of the type having a first and second securement means near a top of an upper opening thereof, said first and second securement means extending to right and left sides of the bag, wherein the improvement comprises:

a first inelastically deformable member fabricated from an iron wire secured adjacent and below said first securement means, said first inelastically deformable member extending from said right side to said left side of said reclosable bag;

a second inelastically deformable member fabricated from an iron wire secured adjacent and below said second securement means, said second inelastically deformable member extending from said right side to said left side of said reclosable bag and wherein said first and said second inelastically deformable members have a right end and a left end and wherein said first and second inelastically deformable members are fused together at the right and left ends thereof whereby when said bag is opened and the first and/or second inelastically deformable members are bent into a desired shape, the inelastically deformed member will retain the bent shape and facilitate the emptying, filling or using the contents thereof.

* * * * *